US012550953B2

(12) United States Patent
Zanes et al.

(10) Patent No.: US 12,550,953 B2
(45) Date of Patent: Feb. 17, 2026

(54) SEPARABLE GARMENT FOR MAINTAINING SECURE DUTY BELT

(71) Applicants: Michele Zanes, Atlantic City, NJ (US); Aaron Cohen, Jenkintown, PA (US)

(72) Inventors: Michele Zanes, Atlantic City, NJ (US); Aaron Cohen, Jenkintown, PA (US)

( * ) Notice: Subject to any disclaimer, the term of this patent is extended or adjusted under 35 U.S.C. 154(b) by 11 days.

(21) Appl. No.: 17/726,205

(22) Filed: Apr. 21, 2022

(65) Prior Publication Data

US 2022/0338565 A1 Oct. 27, 2022

Related U.S. Application Data

(60) Provisional application No. 63/178,649, filed on Apr. 23, 2021.

(51) Int. Cl.

| | |
|---|---|
| ***A41D 13/00*** | (2006.01) |
| ***A41D 1/06*** | (2006.01) |
| ***A41D 31/08*** | (2019.01) |
| ***A41D 31/24*** | (2019.01) |
| ***A41F 9/00*** | (2006.01) |

(52) U.S. Cl.

CPC ..... *A41D 13/0012* (2013.01); *A41D 1/06* (2013.01); *A41D 31/08* (2019.02); *A41D 31/24* (2019.02); *A41F 9/00* (2013.01); *A41D 2400/44* (2013.01)

(58) Field of Classification Search

CPC ..... A41D 13/0012; A41D 1/06; A41D 13/02; A41D 13/129; A41D 31/08; A41D 31/24; A41D 2400/44; A41D 2400/70; A41F 9/00; A41F 1/008; A41F 5/00; A41F 9/02; F41H 1/02; A62B 17/003

See application file for complete search history.

(56) References Cited

U.S. PATENT DOCUMENTS

| | | | | |
|---|---|---|---|---|
| 5,819,320 | A * | 10/1998 | Jolla | A41F 9/00 2/227 |
| 6,108,819 | A * | 8/2000 | DeBaene | A41D 1/067 2/237 |
| 6,158,056 | A * | 12/2000 | Riley | A41D 15/002 2/81 |
| 9,723,885 | B2 * | 8/2017 | Shoraka | A41C 1/08 |
| 2009/0235431 | A1 * | 9/2009 | Bevley | A41F 9/00 2/338 |
| 2011/0004982 | A1 * | 1/2011 | Henningsen | A41D 13/02 2/243.1 |
| 2012/0052770 | A1 * | 3/2012 | Bhojwani | A41F 9/00 450/95 |
| 2019/0323800 | A1 * | 10/2019 | Böhringer | A41D 31/30 |
| 2021/0076752 | A1 * | 3/2021 | Ceraolo | A41D 15/00 |

FOREIGN PATENT DOCUMENTS

| | | | | |
|---|---|---|---|---|
| WO | WO-2006072450 | A2 * | 7/2006 | A41D 13/02 |

* cited by examiner

*Primary Examiner* — Aiying Zhao

(74) *Attorney, Agent, or Firm* — Tracnik Law, LLC; Joseph P Kincart

(57) ABSTRACT

Separable articles of clothing such as trousers to allow for field removal of the lower portion of the trousers are disclosed while maintaining control of a duty belt attached to an upper portion. Two or more separate portions of trousers may be removably attached by an attachment mechanism, such as a zipper. The zipper can be unzipped to allow for restroom use without completely removing the trousers. This may be especially useful for first responders, or other professions requiring complex trousers and a need to maintain control of their duty belt and its contents at all times.

8 Claims, 7 Drawing Sheets

SEPARABLE GARMENT FOR MAINTAINING SECURE DUTY BELT

CROSS REFERENCE TO RELATED APPLICATIONS

This application claims the benefit of U.S. Provisional Application No. 63/178,649 filed Apr. 23, 2021 and titled SEPARABLE GARMENT FOR MAINTAINING SECURE DUTY BELT, the entire contents of which is incorporated herein by reference.

FIELD OF THE INVENTION

The present invention relates to a garment with separable parts that allows for maintaining secure attachment of a duty belt to a worker for an entirety of a work shift.

BACKGROUND OF THE INVENTION

Our society relies on frontline workers, such as law enforcement personnel, firefighters, and other essential personnel. Many of these frontline workers have specific needs to wear a duty belt or other specialized equipment, which may include specific trousers. Other workers, such as utility workers, find is useful to maintain tools and/or equipment in a secure place. Traditionally, a duty belt or tool belt was attached to, or part of a belt that also was secured to trousers being worn by the worker. During a restroom break, the duty belt would be placed in a position that was not secured to the worker.

In addition, trousers associated with the duty belt involve varying levels of difficulty in removal. This may cause certain difficulties for frontline workers. For example, if a frontline worker needs to use the restroom, the frontline worker may spend precious minutes removing their trousers and redressing.

Other trousers in the art that have addressed this problem include "farmer flaps" which provide limited access to areas necessary for completing a restroom break. However, such flaps provide only limited access to body parts and lack structural integrity, which can be problematic for first responders or law enforcement who work in hazardous environments.

SUMMARY OF THE INVENTION

Accordingly, the present invention provides separable trousers that allow for speedy removal and redressing and allow a duty belt to remain secure about a torso of a frontline worker at all times during a duty shift. According to the present disclosure, a separable garment such as a pair of trousers, pants, shorts, skort or other item that is secured around the wearer's torso and extends down the wearer's legs, may include a top portion and a lower portion. A duty belt may remain secured to the top portion of the trousers and also secured about a torso of a worker wearing the trousers. The top portion may also be attachable to the lower portion via a lateral connecting device girdling the trousers, such as one or more of: a zipper; a hook and-loop assembly, a snap, a button, or other device that removably fixes the top portion to the lower portion.

In some embodiments, the lateral connecting device including two sides may have one or both sides of the lateral connecting device supported in an expandable material that allows for stretching during wearing of the garment and during fastening of the top portion and lower portion.

Embodiments of the present disclosure may include an article of clothing including a first portion of the article of clothing and at least a second portion of the article of clothing. In some embodiments, the first portion of the article of clothing may include at least a waist band and a series of attached loops of fabric.

In some embodiments, the second portion of the article of clothing may include at least a set of tubes of fabric to surround legs of a user. Embodiments may also include a means of attachment. In some embodiments, the means of attachment may include a first portion of the means of attachment attached to the first portion of the article and a second portion of the means of attachment attached to the second portion of article of clothing.

In some embodiments, the first portion of the means of attachment may be reversibly attachable to the second portion of the means of attachment. In some embodiments, a user of the article of clothing may separate the first portion of the means of attachment and the second portion of the means of attachment to render a separated article of clothing into a separation of the first portion of the article clothing from the second portion of the article of clothing.

Embodiments of the present disclosure may also include a method of crafting an article of clothing, the method including obtaining a first portion of the article of clothing and at least a second portion of the article of clothing. In some embodiments, the first portion of the article of clothing may include at least a waist band and a series of attached loops of fabric.

In some embodiments, the second portion of the article of clothing may include at least a set of tubes of fabric to surround legs of a user. Embodiments may also include sewing a first portion of a zipper to the first portion of the article of clothing. Embodiments may also include sewing a second portion of the zipper to the second portion of the article of clothing. In some embodiments, a user of the article of clothing may separate the first portion of the zipper and the second portion of the zipper to render a separated article of clothing into a separation of the first portion of the article of clothing from the second portion of the article of clothing.

In some embodiments, the first portion of the article of clothing may be formed by sewing a set of fabric pieces together. In some embodiments, the first portion of the article of clothing may be formed by cutting a portion of a stock piece of clothing into a separate portion of the stock piece of clothing. In some embodiments, the second portion of the article of clothing may be resistant to bullets. In some embodiments, the second portion of the article of clothing may be resistant to fire.

Embodiments of the present disclosure may also include a method of using an article of clothing. The method may include receiving an article of clothing. In some embodiments, the article of clothing may include a first portion of the article of clothing and at least a second portion of the article of clothing. In some embodiments, the first portion of the article of clothing may include at least a waist band and a series of attached loops of fabric. In some embodiments, the second portion of the article of clothing may include at least a set of tubes of fabric to surround legs of a user. Embodiments may also include a zipper. In some embodiments, the zipper may include a first portion of the zipper attached to the first portion of the article of clothing and a second portion of the zipper attached to the second portion of article of clothing. In some embodiments, the first portion of the zipper may be reversibly attachable to the second portion of the zipper. In some embodiments, a user of the article of clothing may separate the first portion of the zipper and the second portion of the zipper to render a separated article of clothing into a separation of the first portion of the article clothing from the second portion of the article of clothing.

Other embodiments may also include wearing the article of clothing. In some embodiments, the first portion of the article of clothing may be joined to the second portion of the article of clothing with the zipper. Embodiments may also include wearing a utility belt. In some embodiments, the utility belt may be connected through at least a first fastening device to the first portion of the article of clothing. Embodiments may also include detaching the second portion of the article of clothing from the first portion of the article of clothing when the zipper may be decoupled. In some embodiments, the utility belt may include a holder for a firearm. In some embodiments, the method may further include using a sanitary facility while the article of clothing may be detached into a separated first portion of the article of clothing and second portion of the article of clothing.

In some embodiments, the method of wearing the article of clothing may further include responding to an emergency situation while the article of clothing may be detached. In some embodiments, the method may further include grabbing the firearm. In some embodiments, the firearm may be holstered to the utility belt. In some embodiments, the utility belt may be connected to the first portion of the article of clothing. In some embodiments, the second portion of the article of clothing may be resistant to bullets. In some embodiments, the second portion of the article of clothing may be resistant to fire. In some embodiments, the utility belt may include a holder for a lighting device.

DESCRIPTION OF THE DRAWINGS

The accompanying drawings, which are incorporated in and constitute a part of this specification, illustrate several embodiments of the disclosure. Together with the description, these drawings serve to explain the principles of the disclosure.

DETAILED DESCRIPTION

The present invention provides for a garment worn on a torso that allows for access to a lower torso body area while maintaining a duty belt in a secure position on the torso of the wearer. A garment may include, for example a pair of trousers, trousers, shorts, skort or other garment that girdles the wearers torso. In preferred embodiments, the garment will also girdle at least one leg of the wearer, such as a garment extending from a waist of the wearer covering the lower part of the wearer's torso (sometimes referred to as a trunk of the wearer) and each leg separately. Embodiments may include a leg covering extending to an ankle of the wearer, or alternatively to extending past the knee, or extending to an area above the knee of the wearer.

Some exemplary embodiments include a pair of trousers with an upper portion and lower portion that is separable along a lower torso of a worker, such as a law enforcement worker; a frontline emergency worker; or utility worker required to wear a duty belt. The separable trousers include a lower portion removably attached to a top portion of the trousers. The lower portion will include leg portions for each leg of the wearer.

A removeable attachment may occur via, for example, a zipper or a Velcro® setup. In some embodiments, a fabric may be used to link the top and lower portion even while the trousers are in a separated state.

In the following sections, detailed descriptions of examples and methods of the invention will be given. The description of both preferred and alternative examples, though thorough, are exemplary only. It is understood that, to those skilled in the art, various, modifications, and alterations may be apparent. The examples do not limit the broadness of the aspects of the underlying invention as defined by the claims.

Figure 1:
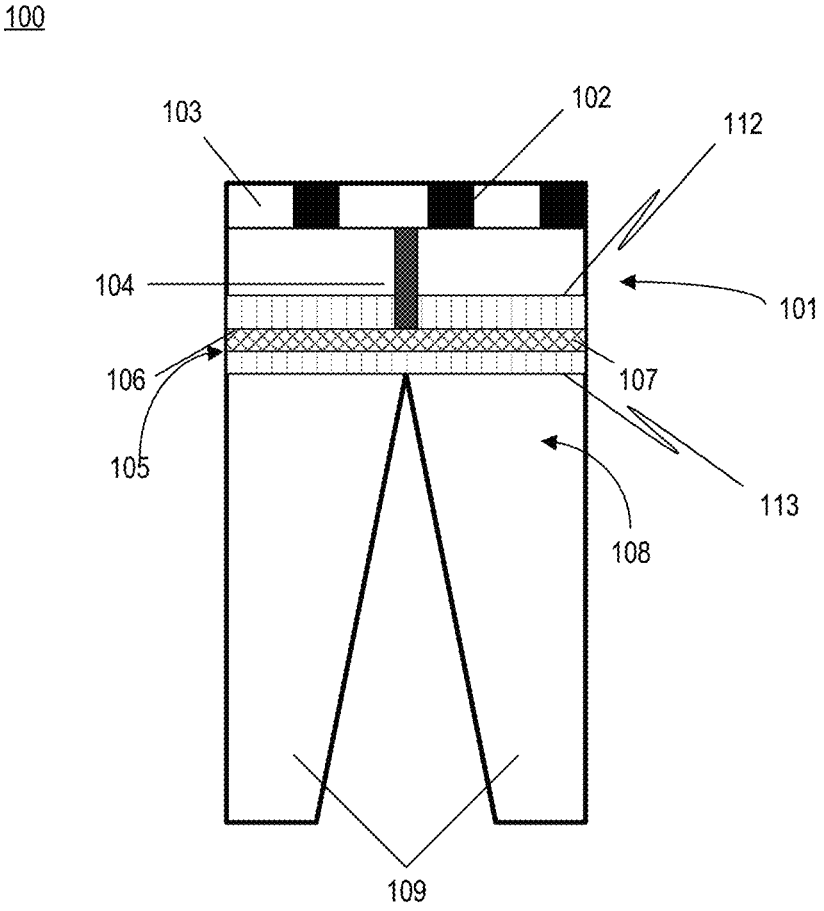
FIG. 1 illustrates a front side view of an exemplary embodiment of the separable trousers described herein.

FIG. 1 illustrates an exemplary embodiment of the separable trousers 100 for frontline workers. Separable trousers 100 may be made of one material, a synthetic comprising multiple materials, or several materials in disparate portions of separable trousers 100. Separable trousers 100 may include one or more layers of such material, as necessary. A material may be chosen as appropriate to the specific occupation of the frontline worker. For example, if the garment wearer is a firefighter, then the material may include a fireproof or fire-retardant material, such as a Kevlar® blend. A garment for a law enforcement officer or a utility worker may include Spandex® or other rugged and expandable material for additional flexibility. A garment for a healthcare professional, may include cotton, polyester, Spandex®, rayon, etc. The foregoing are not meant to be limiting; rather, they are merely exemplary.

Separable trousers 100 may include a top portion 101 and a lower portion 108. Top portion 101 may be generally configured to sit around a wearer's torso, such as an area of the wearer covering the wearer's waist and groin region. The top portion may include an attachment device 102 to attach the duty belt 103. In some embodiments, attachment device 102 may include belt loops, which may be sized to permit the inclusion of the duty belt 103. In some embodiments, duty belt 103 may include attachment areas for securing appropriate items used by the wearer during a work shift. Items supported by the duty belt that may be used during a shift may include, for example a firearm, stun gun, chemical deterrent, tools, blades, electronic devices, weapons, flashlights, handcuffs, resuscitation guards, communications equipment (e.g., radio, phone, or location beacon), and the like.

According to the present invention, the duty belt may stay secured to the wearer for an entirety of a work shift, even during trips to the restroom or other reason to gain access to the lower torso area of the wearer. In some embodiments, a suspender-attachment system may allow the top portion 101 and the lower portion 108 to remain within proximity to each other and still allow access to the lower torso of the wearer.

In some embodiments, a garment according to the present invention may include separable trousers 100 with a removable-attachment mechanism 105 that may include a combination of upper attachment mechanisms 106 and lower attachment mechanisms 107 (described below). The removable-attachment mechanism 105 will girdle the wearer and divide the garment in a lateral manner that encircles a lower torso region of the user.

Lower portion 108 may include one or more leg portions 109. Leg portions may be nearly cylindrical and may have a diameter appropriate to admit a leg of a wearer. In some embodiments, the diameter may be larger to allow for more comfort for a wearer or to allow for different wearers to wear separable trousers 100. In some embodiments, lower portion 108 may include one or more utility pockets. The utility pockets may comprise Spandex or other stretchable fabric and may include a utility zipper.

Depending upon an anticipated deployment condition, one or both of top portion 101 and lower portion 108 may be made of a material or have additional features that aid the wearer in those deployment conditions. For example, in some embodiments, one or both of top portion 101 and lower portion 108 may be made of a fireproof or a fire-retardant material, such as a Kevlar® blend, where the deployment condition relates to extreme temperatures or the presence of a fire. Similarly, one or both of top portion 101 and lower portion 108 may be made of a waterproof or water-resistant material, such as plastic, coated nylon, or Gore-Tex®.

In addition, lower portion 108 may include additional, built-in features not shown in FIG. 1. These may also depend upon a deployment condition. For example, the knees of leg portion 109 may be reinforced. This reinforcement may be realized by, for example, fabric patches on the knees (where the fabric patch may be made of the same, different, heavier, or lighter material than that used for the rest of separable trousers 100 and may include heavyweight cotton, canvas, or nylon). The additional features may include additional pockets or other storage apparatus (such as clip-on pouches) and body armor (such as, for example, Kevlar®). In some embodiments, lower portion 108 may be made of a heavier or a lighter material, depending upon a deployment condition. For example, it may be desirable to have lower portion 108 made from a lighter material where greater flexibility is desired, such as in Urban Search & Rescue deployments. Alternatively, it may be desirable to have lower portion 108 made from a heavier material where greater stability or safety is desired, such as in construction or urban combat zones.

Top portion 101 and lower portion 108 may be removably attached to each other by a removable-attachment mechanism 105. Removable-attachment mechanism 105 enables the separation of separable trousers 100 and may be chosen based on the material of separable trousers 100. In this way, the top portion 101 may stay intact on the user, while the lower portion may be replaced according to need (e.g., the when the lower portion is soiled or damaged, or needs to be preserved, such as for evidence). In an exemplary embodiment, removable-attachment mechanism 105 comprises an upper attachment mechanism 106 and a lower attachment mechanism 107. For example, in some embodiments, removable-attachment mechanism 105 comprises a zipper. In such embodiments, upper attachment mechanism 106 may comprise an upper set of protruding teeth, and lower attachment mechanism 107 may comprise a lower set of protruding teeth designed to interlock with the upper set of protruding teeth. In this embodiment, it may be desirable to surround (or partially surround) the zipper with a Spandex (or other stretchable fabric) that houses the zipper for function and comfort. In such embodiments, this surrounding material may include a pattern, a camouflage, or other decorative features.

In an alternate embodiment, removable-attachment mechanism 105 may comprise Velcro®. In this embodiment, it may be desirable to further secure the Velcro® strips via, for example, cloth ties that may be tied to loops within separable trousers 100. Removable-attachment mechanism 105 may include snaps.

While FIG. 1 specifically shows trousers that separate into two portions, three or more portions are also contemplated by this disclosure. For example, lower attachment mechanism 107 may be placed along a top of leg portion 109. In this way, the legs of the separable trousers may be removed separately, allowing the trousers to convert into shorts.

Figure 2:
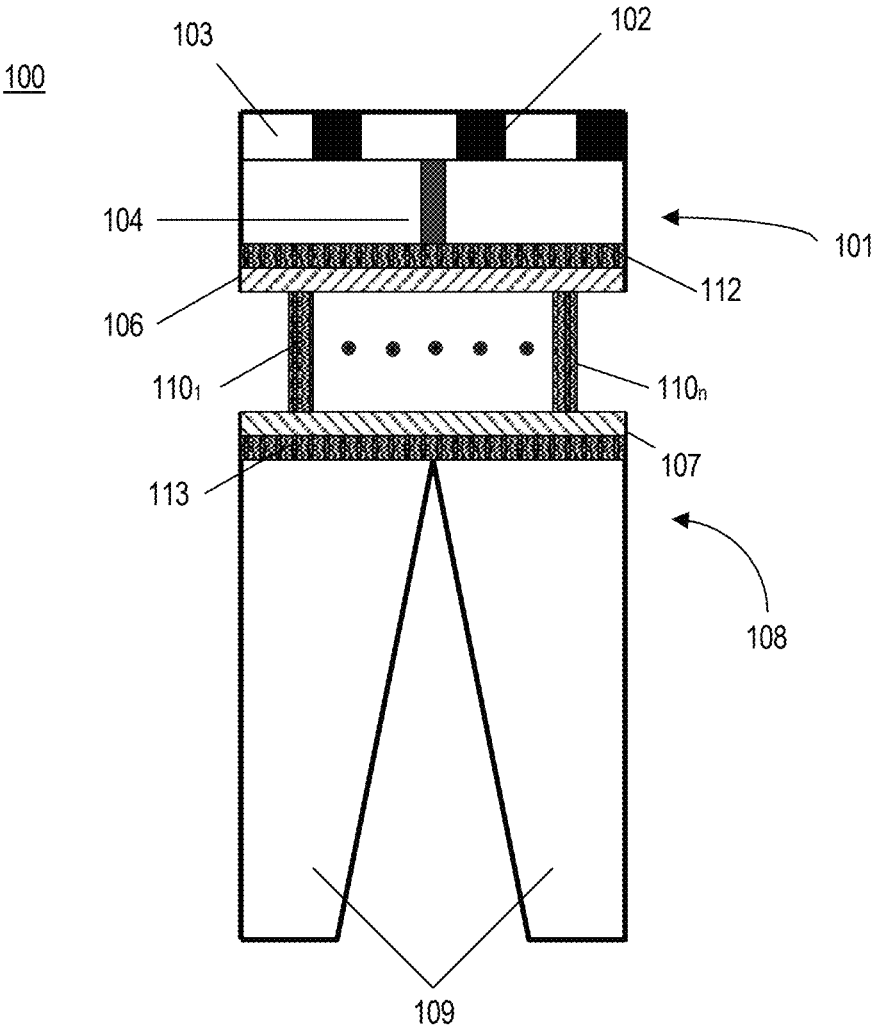
FIG. 2 illustrates a view of an exemplary embodiment of the separable trousers in a separated state.

Referring now to FIG. 2, an exemplary embodiment of separable trousers 100 is shown. In this embodiment, top portion 101 and lower portion 108 are connected by one or more bridges $\mathbf{110}_1 \ldots \mathbf{100}_n$. The bridges $\mathbf{110}_1 \ldots \mathbf{100}_n$ may include material with an attachment device (such as a hook, button, snap, or Velcro®) to hold and support separable trousers 100 while separable trousers are (or are not) unified by removable-attachment mechanism 105 as shown in FIG. 1. In some embodiments, a bridge may include, for example, a flexible material, such as an elastic band, spandex, or rubber. Other embodiments, include a bridge fashioned like a strap, such as a nylon or leather, or cloth like material.

As discussed with respect to FIG. 1, FIG. 2 shows removable-attachment mechanism 105 with adjacent lower expandable material 113 and upper expandable material 112 that may stretch in one or more directions, such as for example, a Spandex® fabric. This may be useful, for example, to allow a worker (or others needing specialized trousers while deployed) to use a restroom without needing to completely disrobe, which may be a time-consuming process with traditional styles of garments. In addition, traditional styles of garments would entail separation of the worker from their duty belt which creates security risks.

In another aspect, separable lower portions may be useful, where necessary, to discard or preserve the lower portion 108, such as when lower portion 108 is soiled or damaged, or when there is evidence on lower portion 108.

Figure 3:
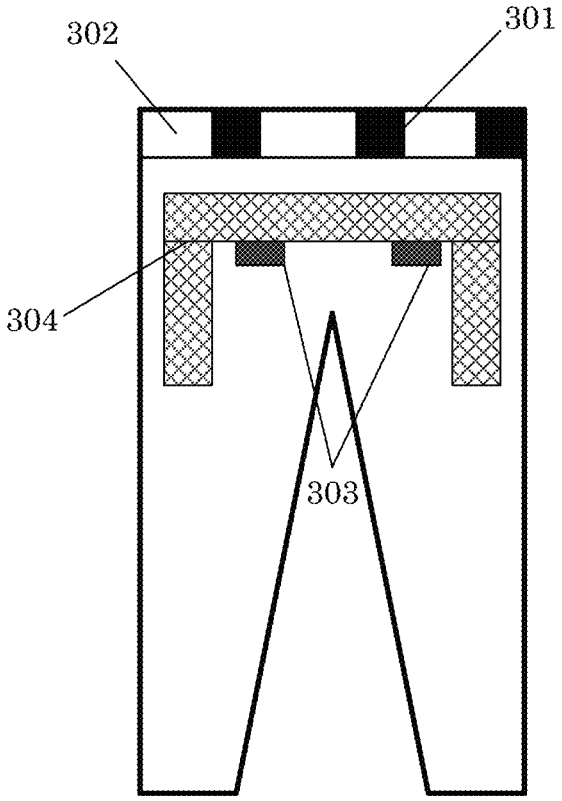
FIG. 3 illustrates a rear view of an alternative embodiment of the separable trousers.

Referring now to FIG. 3, a rear view of an alternate embodiment of separable trousers 300 is shown. This embodiment may include belt loops 301, which may be sized to permit the inclusion of belt 302. In this embodiment, separation may occur via separation flap 304. Separation flap 304 may be a large pouch, such as one created by a zipper, Velcro®, or some other fastening means, around a rear portion of separable trousers 300. A user can unzip or unfasten the separation flap 304 and re-zip or refasten separation flap 304 as needed. In some embodiments, separable trousers 300 may include one or more rear pockets 303. Rear pockets 303 may include an appropriate amount of pocket space. Rear pockets 303 may further include one or more fastening means to assist items in rear pockets 303 from falling out of rear pockets 303 when separation flap 304 is unzipped or unfastened.

Figure 4:
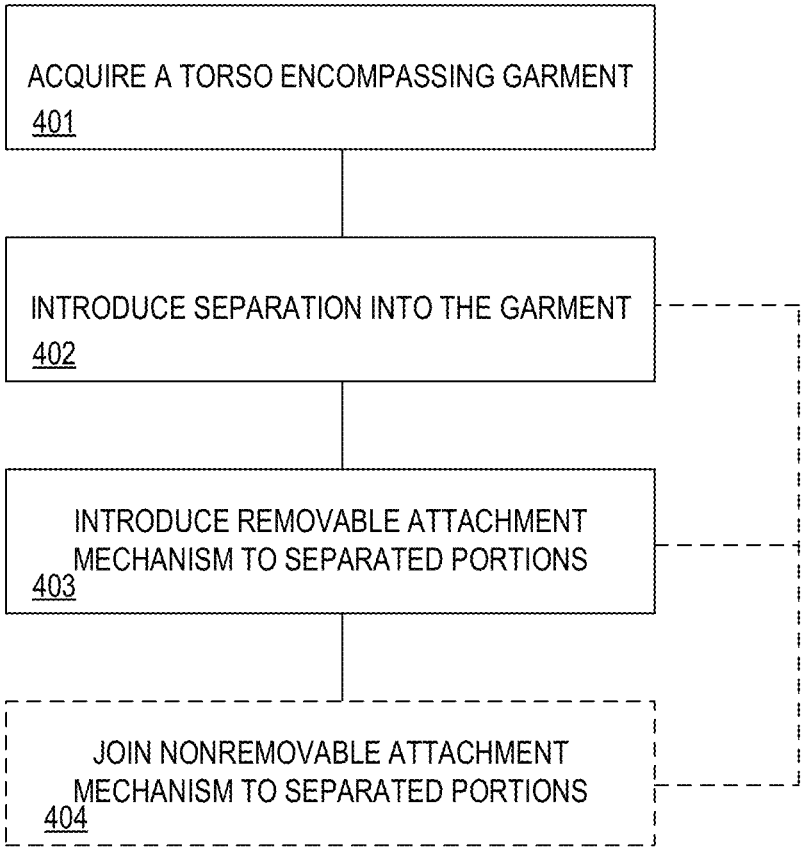
FIG. 4 is a flowchart illustrating an exemplary process flow for implementing the present invention.

Referring now to FIG. 4, a method of crafting a separable garment is illustrated. At step 401, a suitable garment, such as a pair of trousers, is acquired. Suitability may be determined according to potential use (e.g., Kevlar® or other fireproof or fire-resistant material for bunker trousers for firefighters), ease of modification, stylistic choices, or other factors influencing a choice of trousers. The trousers may have additional features, such as reinforced knees, additional pockets or other storage, body armor, etc. In some embodiments, it may be desirable to sew zipper 104 to secure the positioning of top portion 101 (as shown in FIG. 2). In other embodiments, a button or a stock zipper may serve the purpose of zipper 104. The article of clothing also includes a second zipper 104 positioned perpendicular to the first zipper 105, located between the first zipper 105 and the waistband of the article of clothing. This second zipper 104 serves to further secure the positioning of the first portion 101 of the article of clothing relative to the second portion 108.

An upper portion may be configured to allow the user to have essential equipment items to stay within reach of the worker. For example, these equipment items may include weapons, flashlights, handcuffs, resuscitation guards, communications equipment (e.g., radio, phone, or location beacon). They may be attached to a point within reach of the work by, for example, a utility belt, safety belt, receiving end for a clipping apparatus, or a magnetic attachment point.

At step 402, a separation is introduced into the trousers. For example, the trousers may be cut into two completely separate pieces (as shown in the embodiment described in FIG. 1). Similarly, the trousers may be cut into partially separate pieces. For example, in some embodiments, a flap may be cut along a track in the trousers.

At step 403, a removable attachment mechanism is introduced to ends of each separated portion to attach the two separated portions. For example, the removable attachment mechanism may be a zipper, a Velcro® system, a loop-and-hook system, etc. The removable attachment mechanism allows for the two portions to be separated at need or at will. For example, it may be desirable to separate the lower portion when it is soiled or damaged, or when it needs to be preserved (e.g., for evidentiary purposes) while leaving the upper portion attached to the user.

At optional step 404, the two separated portions may be joined by flexible, a nonremovable attachment mechanism. For example, as shown in FIG. 2, the two portions may be joined together by two fabric bridges. In that example, the fabric bridges may initially be slack within the slacks, but as the separated portions are pulled apart, the fabric bridges may contract to prevent further separation. In this way, the portions, when separated, remain flexibly bound together. This may also provide additional structural integrity in the case of a failure of the removable attachment mechanism.

Figure 4A:
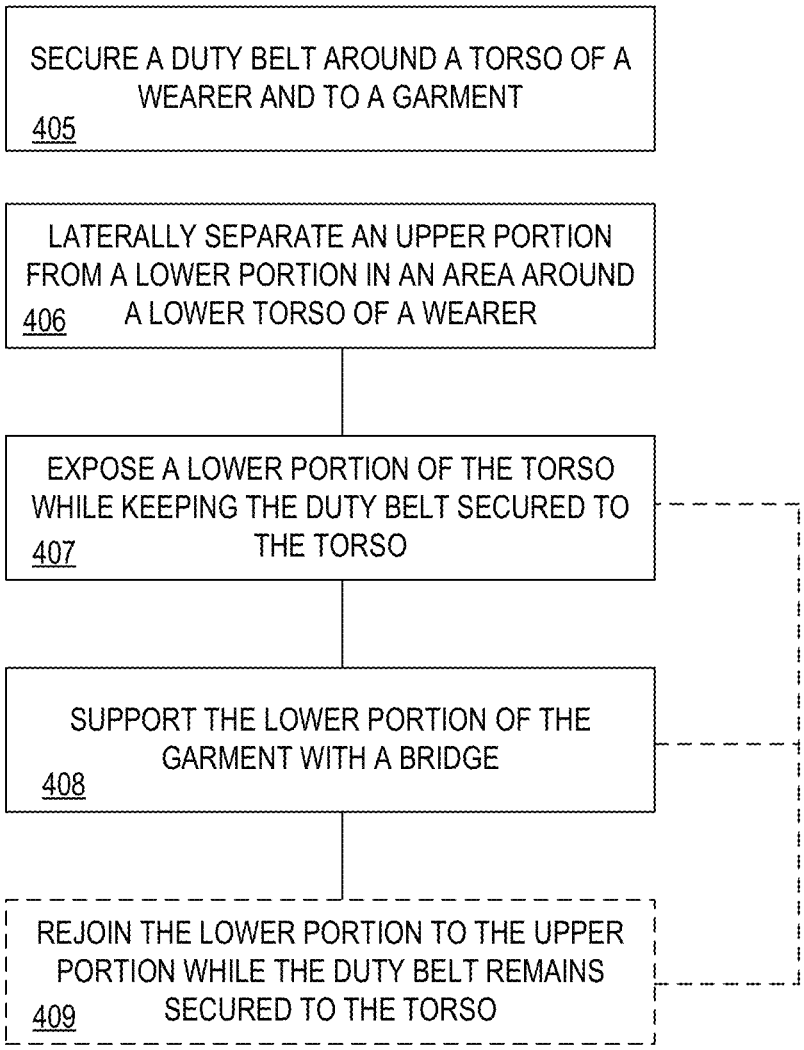
FIG. 4A is a flowchart illustrating an exemplary process flow for implementing the present invention.

Referring now to FIG. 4A, method steps for deploying a garment with secured duty belt is illustrated with come exemplary steps that may be practiced according to the present invention. At step 405, a duty belt may be secured around a torso of at wearer of a separable garment and also be fixedly attached to the separable garment.

At step 406, an upper portion of the separable garment may be separated from the lower portion in an area that is around a lower torso of the wearer of the garment.

At step 407, a lower portion of the torso may be exposed while keeping the duty belt secured to the torso of the wearer and also keeping the upper portion of the garment on the wearer.

At step 408, in some embodiments, a lower portion of the garment may be supported, while separated from the top portion via one or more support bridges.

At step 409, the lower power may be rejoined to the upper portion while the duty belt remains secured to the torso of the wearer's body.

Although the foregoing discussion specifically addresses separating the trousers (partially or completely) into two parts, it should be readily apparent to a person of ordinary skill in the art that more separations may be introduced. For example, it may be desirable to make two cuts into the trousers along a pelvic diagonal to allow for separation of each leg of the trousers. This may be desirable to allow the separable trousers to convert from trousers to shorts, boxers, etc. As described in the steps above, each of these separable portions may be attached to one or more of the other portions via removable attachment mechanism, such as a zipper. Accordingly, steps 402-403 or 402-404 may be repeated, as necessary.

Figure 5:
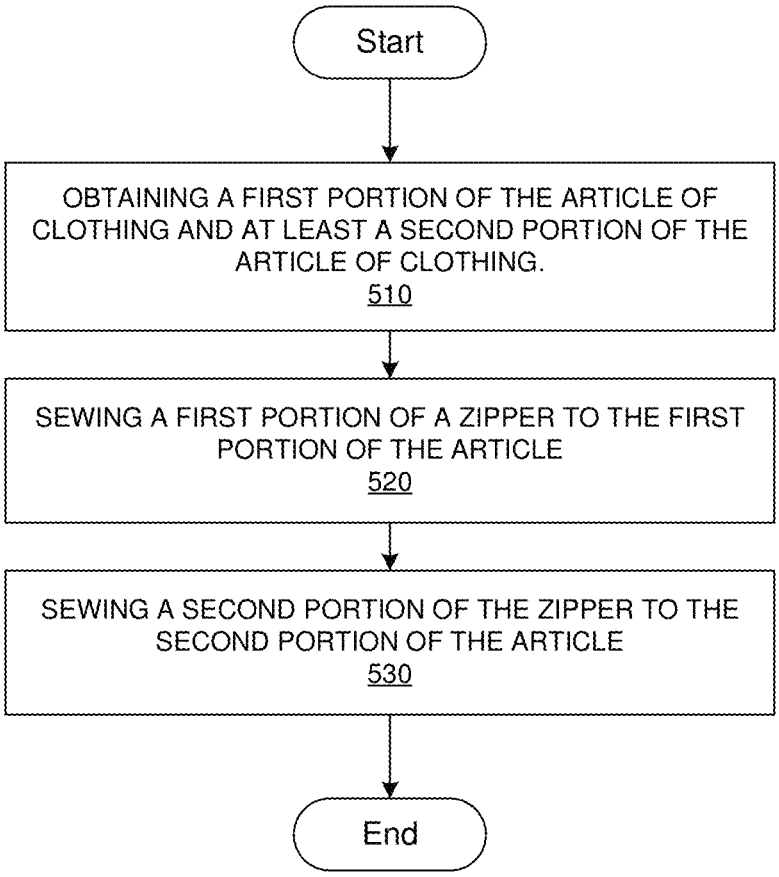
FIG. 5 is a flowchart illustrating a method of crafting an article of clothing, according to some embodiments of the present disclosure.

Referring now to FIG. 5, there is a flowchart that shows a method of crafting an article of clothing, according to some embodiments of the present disclosure. At step 510, the method may include obtaining a first portion of the article of clothing and at least a second portion of the article of clothing. In some embodiments, the first portion of the article of clothing comprises at least a waist band and a series of attached loops of fabric. In some embodiments, the second portion of the article of clothing comprises at least a set of tubes of fabric to surround legs of a user.

At step 520, the method may include sewing a first portion of a zipper to the first portion of the article of clothing. At step 530, the method may include sewing a second portion of the zipper to the second portion of the article of clothing. In some embodiments, a user of the article of clothing may separate the first portion of the zipper and the second portion of the zipper to render a separated article of clothing into a separation of the first portion of the article of clothing from the second portion of the article of clothing.

In some embodiments, the first portion of the article of clothing may be formed by sewing a set of fabric pieces together. In some embodiments, the first portion of the article of clothing may be formed by cutting a portion of a stock piece of clothing into a separate portion of the stock piece of clothing. In some embodiments, the second portion of the article of clothing may be resistant to bullets. In some embodiments, the second portion of the article of clothing may be resistant to fire.

Figure 6:
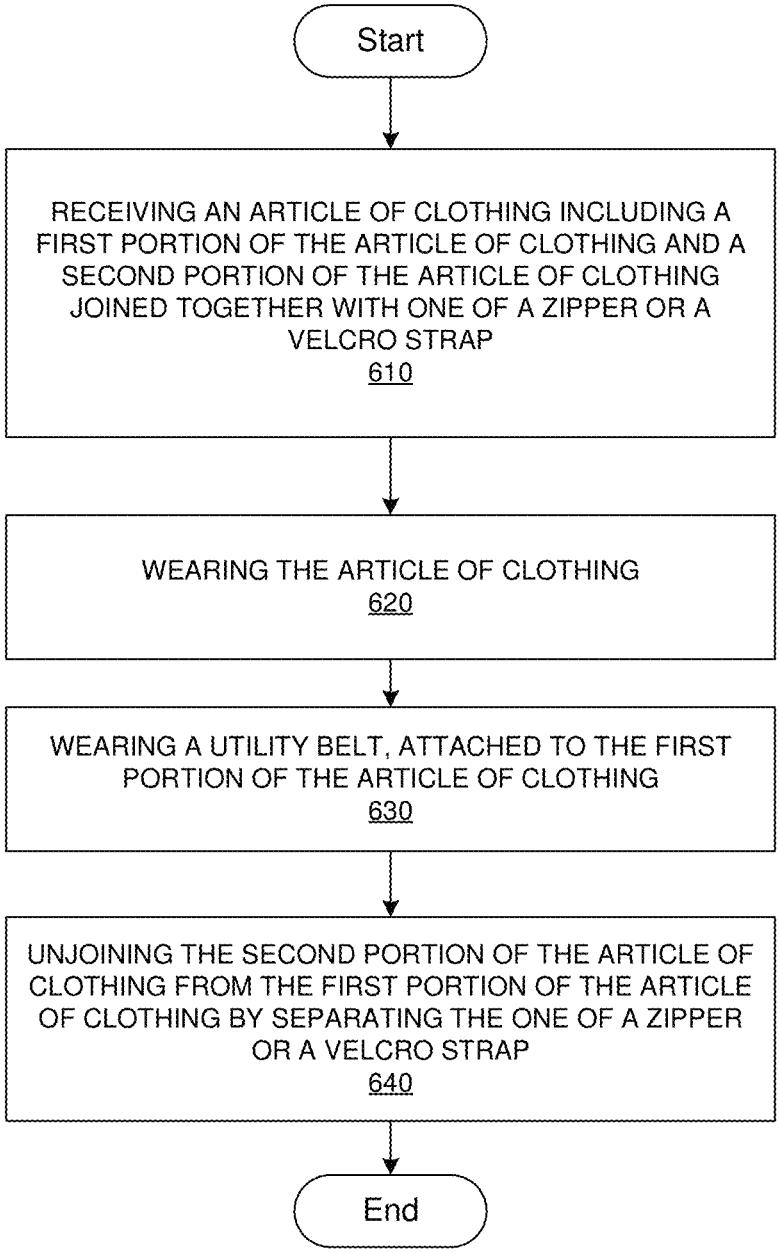
FIG. 6 is a flowchart illustrating a method of using an article of clothing, according to some embodiments of the present disclosure

FIG. 6 is a flowchart that shows a method of using an article of clothing, according to some embodiments of the present disclosure. At step 610, the method may include receiving an article of clothing. In some embodiments, a first portion of the article of clothing and at least a second portion of the article of clothing may be joined together by a joining means such as a zipper or a Velcro® strap. Other means of reversibly joining together to portions of an article of clothing as have been described may also be utilized. In some embodiments, the first portion of the article of clothing comprises at least a waist band and a series of attached loops of fabric. In some embodiments, the second portion of the article of clothing comprises at least a set of tubes of fabric to surround legs of a user. In some embodiments, a zipper may be used to join together the first portion of the article of clothing and the second portion of the article of clothing. In some embodiments, the zipper may include a first portion of the zipper attached to the first portion of the article of clothing and a second portion of the zipper attached to the second portion of article of clothing. In some embodiments, the first portion of the zipper may be reversibly attachable to the second portion of the zipper.

In some embodiments, a user of the article of clothing may separate the first portion of the zipper and the second portion of the zipper to render a separated article of clothing into a separation of the first portion of the article clothing from the second portion of the article of clothing. At step 620, the method may include wearing the article of clothing.

In some embodiments, the first portion of the article of clothing o may be joined to the second portion of the article of clothing with the zipper.

At step 630, the method may include wearing a utility belt. In some embodiments, the utility belt may be connected through at least a first fastening device to the first portion of the article of clothing. At step 640, the method may include detaching the second portion of the article of clothing from the first portion of the article of clothing when the zipper may be decoupled. In some embodiments, the utility belt may comprise a holder for a firearm.

The method may further include using a sanitary facility while the article of clothing is detached into a separated first portion of the article of clothing and second portion of the article of clothing. In some embodiments, the method may further include responding to an emergency situation while the article of clothing may be detached. In some embodiments, the method may further include grabbing the firearm.

In some embodiments, the firearm may be holstered to the utility belt. In some embodiments, the utility belt may be connected to the first portion of the article of clothing. In some embodiments, the second portion of the article of clothing may be resistant to bullets. In some embodiments, the second portion of the article of clothing may be resistant to fire. In some embodiments, the utility belt may comprise a holder for a lighting device.

CONCLUSION

Several embodiments of the present disclosure have been described. While this specification contains many specific implementation details, these should not be construed as limitations on the scope of any disclosures or of what may be claimed, but rather as descriptions of features specific to particular embodiments of the present disclosure. While embodiments of the present disclosure are described herein by way of example using several illustrative drawings, those skilled in the art will recognize the present disclosure is not limited to the embodiments or drawings described. It should be understood the drawings and the detailed description herein are not intended to limit the present disclosure to the form disclosed. Instead, the present disclosure is meant to encompass modifications, equivalents, and alternatives falling within the spirit and scope of embodiments of the present disclosure, as defined by the appended claims.

The headings used herein are for organization purposes only and are not meant to be used to limit the scope of the description or the claims. As used throughout this application, the word "may" is used in a permissive sense (i.e., meaning having the potential to), rather than the mandatory sense (i.e., meaning must). Similarly, the word "include" (and derivatives thereof) means including but not limited to. To facilitate understanding, like reference numerals have been used, where possible, to designate like elements common to the figures.

The phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" means A alone, B alone, C alone, A and B together, A and C together, B and C together, or A, B, and C together.

The term "a" or "an" entity means one or more of that entity. As such, "a"/"an," "one or more," and "at least one" are used interchangeably herein. Additionally, "comprising," "including," and "having" can be used interchangeably.

Certain features that are described in this specification in the context of separate embodiments can also be implemented in combination in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination an, in some cases, be excised from the combination, and the claimed combination may be directed to a sub-combination or a variation of a sub-combination.

What is claimed is:

1. A method of using an article of clothing including an attachment device having belt loops, the method comprising the steps of:

receiving an article of clothing, wherein the article of clothing comprises:

a first portion of the article of clothing and a second portion of the article of clothing, wherein the first portion of the article of clothing comprises at least a waist band and a series of attached loops of fabric, and wherein the second portion of the article of clothing comprises at least a set of tubes of fabric to surround legs of a user;

a first zipper configured to be located in a region below the waist band between a groin area and an upper leg area of the article of clothing, wherein the first zipper comprises a first portion of the first zipper attached to the first portion of the article of clothing via an upper expendable material located between the first portion of the first zipper and the first portion of the article of clothing, and a second portion of the first zipper attached to the second portion of the article of clothing via a lower expendable material located between the second portion of the first zipper and the second portion of the article of clothing, wherein the first portion of the first zipper is reversibly attachable to the second portion of the first zipper, wherein the user of the article of clothing may separate the first portion of the first zipper and the second portion of the first zipper to render a partially or completely separated article of clothing into a partial or complete separation of the first portion of the article of clothing from the second portion of the article of clothing; and two support bridges connecting the first portion of the article of clothing to the second portion of the article of clothing, wherein the two support bridges are configured to hold and support the first portion of the article of clothing and the second portion of the article of clothing both when the first zipper couples the first portion of the article of clothing and with the second portion of the article of clothing in a unified state, and when the first zipper is unzipped in a separated state and the first portion of the article of clothing is pulled apart from the second portion of the article of clothing, and wherein the two support bridges are configured to contract to prevent further separation from a partially separated state as the first portion of the article of clothing and the second portion of the article of clothing are pulled apart after the first portion of the first zipper and the second portion of the first zipper are separated, thereby maintaining a flexible connection between the first portion of the article of clothing and the second portion of the article of clothing during the partially separated state;

wearing the article of clothing wherein the first portion of the article of clothing is joined to the second portion of the article of clothing with the first zipper;

attaching a duty belt around a waist of the user by connecting the duty belt through the attachment device having belt loops to the first portion of the article of clothing; and detaching the second portion of the article of clothing from the first portion of the article of clothing when the first zipper is decoupled while maintaining the duty belt in place around the waist of the user.

2. The method of claim 1, wherein the article of clothing further comprises:

a second zipper that is located perpendicular to the first zipper and within the first portion of the article of clothing in between the first zipper and the waist band; and the two support bridges including a strap for holding the first portion of the article of clothing and the second portion of the article of clothing together when the first zipper is decoupled, wherein the duty belt comprises a holder for a firearm.

3. The method of claim 1, wherein the article of clothing further allows for the complete separation of the second portion of the article of clothing from the first portion of the article of clothing by detaching the two support bridges from one of the first portion of the article of clothing or one of the second portion of the article of clothing to completely separate the second portion of the article of clothing when the second portion of the article of clothing is soiled or damaged.

4. The method of claim 2, further comprising detaching the article of clothing into a separated first portion of the article of clothing and a separated second portion of the article of clothing while a sanitary facility is being used.

5. The method of claim 4, further comprising detaching the article of clothing while an emergency situation is being responded to.

6. The method of claim 5 further comprising grabbing a firearm, wherein the firearm is holstered to the duty belt and wherein the duty belt is connected to the first portion of the article of clothing.

7. The method of claim 6 wherein the second portion of the article of clothing is resistant to bullets.

8. The method of claim 7 wherein the second portion of the article of clothing is resistant to fire.

* * * * *